United States Patent [19]

Mortimer

[11] Patent Number: 4,524,902

[45] Date of Patent: Jun. 25, 1985

[54] CARTON HANDLE

[75] Inventor: John K. Mortimer, St. Marys, Australia

[73] Assignee: F. F. Seeley Nominees Pty. Ltd., St. Marys, Australia

[21] Appl. No.: 523,157

[22] Filed: Aug. 15, 1983

[30] Foreign Application Priority Data

Aug. 23, 1982 [AU] Australia ..... PF5518

[51] Int. Cl.[3] ..... B65D 5/46; B65D 25/22; B65D 25/28

[52] U.S. Cl. ..... 229/52 A; 229/52 AL

[58] Field of Search ..... 229/52 A, 52 AL

[56] References Cited

U.S. PATENT DOCUMENTS

| | | | |
|---|---|---|---|
| 1,171,228 | 2/1916 | Misroch et al. | 229/52 A |
| 2,702,660 | 2/1955 | Donaldson | 229/52 A |
| 4,039,121 | 8/1977 | Crane | 229/52 A |
| 4,420,178 | 12/1983 | Taylor et al. | 229/52 A |

FOREIGN PATENT DOCUMENTS 2066214 12/1979 United Kingdom .

*Primary Examiner*—Joseph Man-Fu Moy
*Attorney, Agent, or Firm*—Jay L. Chaskin

[57] ABSTRACT

A carton handle comprises a monolithic moulding of plastics material having a base portion and a pair of hinged portions hinged thereto, said portions all having retaining flanges which retain the handle to a carton, the flanges engaging inner and outer faces of the material of which the carton is formed.

6 Claims, 5 Drawing Figures

CARTON HANDLE

This invention relates to a handle which is useful for the lifting of a carton.

It is already well known that cartons are frequently damaged through incorrect lifting. Cartons are usually made from low-strength cardboard, and if a heavy carton is lifted by the application of a lifting force at the location of an aperture or edge of a carton, the localised force can cause crushing or tearing of the material.

The main object of this invention is to provide an inexpensive handle which will facilitate the handling of a carton, and in one embodiment of this invention a carton handle comprises a monolithic moulding of plastics material having a base portion and a pair of hinged portions hinged thereto, said portions all having retaining flanges which retain the handle to a carton, the flanges engaging inner and outer faces of the material of which the carton is formed.

More specifically, the invention consists of a monolithic moulding of polymeric material which in its as-moulded mode, comprises a base portion, a pair of hinged portions, a pair of parallel hinge webs joining respective said hinged portions to the base portion, retaining flanges on the base portion and also on respective said hinged portions, and interengageable latch means on said hinged portions, the shapes and dimensions of said hinged portions being such that, upon insertion in an aperture in a carton wall, the hinged portions are movable to respective positions wherein their retaining flanges lie contiguous with one surface of said carton wall while the base portion flanges lie contiguous with the opposite surface thereof, and said latch means interengage with one another and thereby inhibit release of said portions from their said respective positions.

Figure 5:
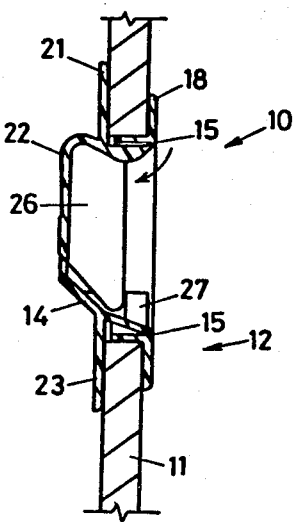
Figure 4:
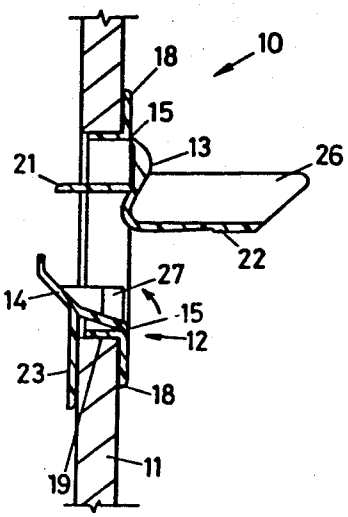
Figure 3:
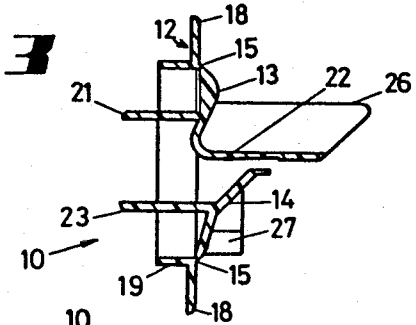
Figure 2:
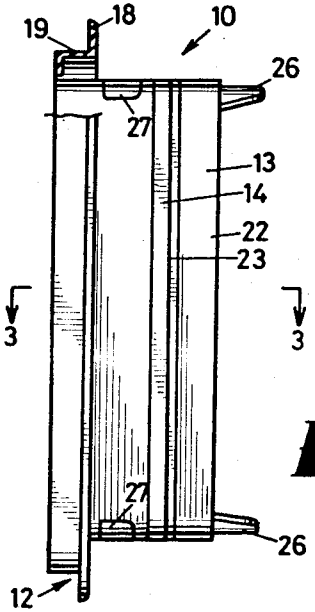
Figure 1:
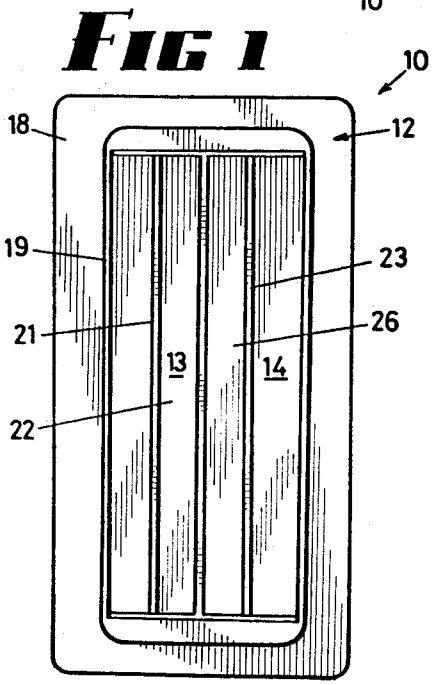

An embodiment of the invention is described hereunder in some detail with reference to, and is illustrated in, the accompanying drawings, in which:

FIG. 1 is a rear elevation of a monolithic carton handle in its moulded mode, FIG. 2 is a partly sectional side elevation of same, FIG. 3 is a section on line 3—3 of FIG. 2, FIG. 4 is a section illustrating the first stage of insertion of the handle into an aperture in the carton wall, and FIG. 5 similarly illustrates the handle fully inserted, with the latch means interengaged.

In this embodiment a handle 10 for engaging a side wall 11 of a carton (not shown) surrounding an aperture comprises a monolithic moulding of plastics material. In order to facilitate moulding, and further in order to facilitate assembly to the carton, the handle is moulded to have three portions, namely a base portion 12, an upper hinged portion 13 and a lower hinged portion 14. The material used is of the type wherein a flexible membrane can withstand fatigue, for example polypropylene, and between each of the hinged portions and the base portion there is a respective thin hinge web 15 which constitutes a hinge.

The base portion 12 is moulded to have a generally rectangular flange 18 extending from a generally rectangular skirt 19, and the hinge webs 15 extend along opposite sides of the base portion at the outer "corner" between the flange 18 and skirt 19 as shown in FIG. 3. The upper hinged portion 13 has a retaining flange 21 extending from a backing plate portion 22, and the lower hinged portion 14 has a retaining flange 23 extending from a backing plate portion 24. When each of the hinged portions is moved through 90 degrees, the retaining flanges 21 and 23 of the hinged portions lie parallel to but spaced from the flanges 18 of the base portion as shown in FIG. 5. However in their as moulded position, the two retaining flanges 21 and 23 of the hinged portions are parallel with one another as shown in FIG. 3.

The upper hinged portion is moulded to have a wide U-shape in front elevation, with the backing plate portion 22 lying between a pair of flanges 26, the backing plate portion 22 being substantially vertical when the hinged portion is folded back as in FIG. 5. The backing plate portion 22 extends downwardly to occupy most of the space of the aperture of the carton, and the lower hinged portion 14 is provided with latching projections 27 which, when the lower hinged portion 14 is folded back, are engaged by the ends of flanges 26 of the upper hinged portion 13 when that is also folded back, so that the two hinged portions retain their positions, with the backing plate portions lying edge to edge. In this position, the upper part of the upper backing plate portion 22 is of general "S" shape in cross-section (FIG. 5), and provides a good finger rip. The backing plate portions lie inwardly of the carton wall and substantially close said aperture.

When it is required to insert the handle in an aperture in a carton wall, the base portion 12 is positioned into the aperture so that the skirt engages the surfaces defining the aperture, the lower hinged portion is folded back, and the upper hinged portion is folded back until the flanges 26 of the upper hinged portion latch behind the projections 27 of the lower hinged portion.

When in this position, the upper hinged portion 13 provides a lifting surface which is arranged to be engaged by the fingers of a user, the lifting surface sloping upwardly and inwardly but only at a shallow angle so that the carton handle cannot be used for pulling the carton sideways, with consequential damage to the material constituted in the carton. The walls of the carton are captive between spaced flanges along both the upper and lower edges of the handle, and this assists in spreading the load. There is very little intrusion into the carton by the handle, and the only outward projection is the thickness of the flange 18.

Various modifications in structure and/or function may be made to the disclosed embodiments by one skilled in the art without departing from the scope of the invention as defined by the claims.

What is claimed is:

1. A carton handle comprising a monolithic moulding of polymeric material which, in its as-moulded mode, comprises a base portion, a pair of hinged portions, a pair of parallel hinge webs joining respective said hinged portions to the base portion, retaining flanges on the base portion and also on respective said hinged portions, and interengageable latch means on said hinged portions, the shapes and dimensions of said hinged portions being such that, upon insertion in an aperture in a carton wall, the hinged portions are movable to respective positions wherein their retaining flanges lie contiguous with one surface of said carton wall while the base portion flanges lie contiguous with the opposite surface thereof, and said latch means interengage with one another and thereby inhibit release of said portions from their said respective positions.

2. A carton handle according to claim 1 wherein each said hinged portion comprises a respective backing plate portion, said backing plate portions lying inwardly of said carton wall and substantially closing said aperture when the handle is inserted therein.

3. A carton handle according to claim 1 or claim 2 wherein said retaining flanges of the hinged portions are substantially parallel with one another in the as-moulded mode.

4. A carton handle according to claim 1 or claim 2 wherein the upper part of the backing plate portion of the upper hinged portion is of general "S" shape in cross-section and provides a finger grip.

5. A carton handle according to claim 1 further comprising a skirt extending inwardly of said base portion and engaging the surfaces defining said carton aperture when the handle is inserted therein.

6. A carton handle according to claim 2 further comprising a skirt extending inwardly of said base portion and engaging the surfaces defining said carton aperture when the handle is inserted therein.

* * * * *